US007144169B2

(12) United States Patent
Ramet

(10) Patent No.: US 7,144,169 B2
(45) Date of Patent: Dec. 5, 2006

(54) PACKAGING DEVICE INTEGRAL WITH AN APPLICATOR

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 230 days.

(21) Appl. No.: 10/813,118

(22) Filed: Mar. 31, 2004

(65) Prior Publication Data

US 2004/0221867 A1 Nov. 11, 2004

Related U.S. Application Data

(60) Provisional application No. 60/470,491, filed on May 15, 2003.

(30) Foreign Application Priority Data

Apr. 11, 2003 (FR) ..... 03 04573

(51) Int. Cl.
*A46B 11/00* (2006.01)
*A46B 15/00* (2006.01)

(52) U.S. Cl. ..... 401/11; 401/9; 401/122; 401/126

(58) Field of Classification Search ..... 401/6, 401/9, 11, 126, 130, 122; 132/317, 320, 132/216, 218; 33/413, 414
See application file for complete search history.

(56) References Cited

U.S. PATENT DOCUMENTS

| | | | | |
|---|---|---|---|---|
| 2,834,356 | A | 5/1958 | Weiler | |
| 3,343,552 | A | 9/1967 | Steffen | |
| 5,013,171 | A * | 5/1991 | Almond, II | 401/6 |
| 6,341,910 | B1 * | 1/2002 | Kuehne | 401/6 |
| 6,393,709 | B1 * | 5/2002 | Jones | 33/414 |
| 6,899,481 | B1 * | 5/2005 | Katsandres et al. | 401/6 |

FOREIGN PATENT DOCUMENTS

| | | |
|---|---|---|
| GB | 2312617 | 11/1997 |

* cited by examiner

*Primary Examiner*—David J. Walczak
(74) *Attorney, Agent, or Firm*—Oblon, Spivak, McClelland, Maier & Neustadt, P.C.

(57) ABSTRACT

A packaging and dispensing device for a product, such as a cosmetic product. The device includes a reservoir containing the product, a cap which is removably mountable on the reservoir, and an applicator capable of being loaded with a quantity of product. A first end of the applicator is connected to the cap, and a second end of the applicator is coupled to the reservoir. The applicator can thus be suspended between the cap and the reservoir to direct the applicator against a surface to apply the product to the surface.

51 Claims, 1 Drawing Sheet

PACKAGING DEVICE INTEGRAL WITH AN APPLICATOR

CROSS REFERENCE TO RELATED APPLICATION

This document claims priority to French Application Number 03 04573, filed Apr. 11, 2003 and U.S. Provisional Application No. 60/470,491, filed May 15, 2003, the entire contents of which are hereby incorporated by reference.

FIELD OF THE INVENTION

The invention relates to a packaging and dispensing device having an applicator in which the applicator is preferably integral or coupled to both a container and a cap of the device. The device can be particularly advantageous for use in applying, for example, a line or lines of make-up or cosmetics such as in applying an eye make-up or a lip liner.

BACKGROUND OF THE INVENTION

Discussion of Background

In the prior art, eyeliners are known in which the applicator in the form of a point is mounted at the end of a rod fixed in a cap, and the cap is mounted on a product reservoir such that the applicator is immersed in the product when the cap is in an assembled position on the reservoir. When the user wishes to draw a line along the edge of her eyelid, she then has to move the point of the applicator evenly along the surface to be coated. This make-up operation is difficult to perform without mistakes. The line obtained often includes unwanted deviations.

U.S. Pat. No. 3,343,552 describes an applicator which is preformed so as to be adapted to the surface to which it is to be applied. However, with this arrangement, the user is first obliged to coat a working surface of the applicator with product using a separate means of coating. Moreover, given the shape of the applicator, it cannot be readily inserted into the product reservoir. The application of eye make-up according to the teaching of this document involves the use of a cumbersome device. In addition, because the applicator is preformed to match the external outline of an average eyelid, it is not suitable for all users. Devices of similar design are also known, notably from U.S. Pat. No. 2,834,356, for the application of a line to the outline of the lips.

SUMMARY OF THE INVENTION

There is a need to provide a packaging and dispensing device of simple design enabling convenient application of a product contained in the device, directly in the form of a line. To this end, the invention provides a flexible applicator of elongated shape suspended between two points so as to obtain a line between these two points. The user controls the precise positioning of these two points and it is possible to apply the line without a mirror if desired.

In accordance with an embodiment of the invention, a cap is intended to cover the reservoir or container and is attached to the reservoir via the applicator. Manipulation of the applicator is accomplished by simultaneously holding the cap and the container, preferably with both hands, one in each hand. The invention can be particularly advantageous for applicators intended for fine and precise application, preferably for the purpose of creating lines. A device according to the invention is principally suitable for the application of eye make-up involving the application of a line to highlight the edge of an eyelid, and/or to highlight the outline of the lips.

To limit the dimensions of such an applicator, a first portion, e.g., a first end of the applicator, corresponding to a first point, is connected or coupled to the cap of the packaging and dispensing device. A second portion, e.g., a second end of the applicator, corresponding to a second point, is connected or coupled to the reservoir or container of the device. The make-up actions involved in using such an applicator preferably involve the use of both hands, with one hand holding the reservoir and the other hand holding the cap, and with the applicator suspended between the two points. Preferably, the user applies the second point of the applicator to the skin and brings the applicator to bear by lowering the first point of the applicator towards the skin so as to form a line on the skin between these two points.

In accordance with an embodiment of the invention, a dispensing and packaging device for a product, notably a cosmetic product, is provided which includes a reservoir or container containing the product, and a cap to close or cover an opening in the reservoir. An applicator is also provided which is capable of being loaded with a quantity of product. In addition, a first means connects a first end of the applicator to the cap while a second means connects a second end of the applicator to the reservoir.

The cosmetic product applied using the device according to the invention is preferably a fluid, and more particularly liquid or semi-liquid. Within the meaning of the cosmetics directive 76/768/CEE, a cosmetic product is defined as any substance or preparation intended to be placed in contact with various superficial parts of the human body (skin, hair, nails, lips) for the exclusive or principal purpose of cleansing, perfuming, modifying the appearance, protecting or conditioning these surfaces.

Advantageously, the applicator remains connected to the first means and to the second means, even during use, and preferably the applicator is inseparable therefrom during normal use.

Also advantageously, the first means is integral with or coupled to the cap. The second means can include a support mounted in a movable manner inside the reservoir and made integral with or coupled to the reservoir, with this support being connected to the second end of the applicator. Preferably, the support includes a retaining means, e.g., a flange portion intended to engage with a counterpart arrangement or counterpart portion on the reservoir. The counterpart arrangement prevents the movable support or flange portion from pulling out of the reservoir. In accordance with an exemplary embodiment, this engagement is obtained by a support having a flange portion on an outer sidewall. In addition, the counterpart arrangement can be formed by a wiper element mounted at the reservoir opening. The flange can then bear or abut against the wiper element.

With the device in the "closed" position, the cap is mounted on the reservoir so as to close off the opening, and the applicator is concealed inside the reservoir in a retracted position. Preferably, the cap is screwed onto an outer circumference of the reservoir. In this "closed" position, the applicator is at least partially immersed in the product.

When the cap is disengaged from the reservoir opening, the applicator is drawn by the cap out of the reservoir. The applicator progressively emerges from the reservoir opening to move the applicator from the retracted position to an extended position. The inner wall of the reservoir is preferably equipped with a wiper element positioned at the opening, with the wiper having an aperture through which the applicator passes. This wiper element serves to wipe off excess product present at the periphery of the applicator. Thus the portion of the applicator emerging from the reservoir presents a more reproducible quantity of product, and this quantity preferably corresponds to that associated with one application.

Advantageously, the applicator is preferably flexible. It can therefore be applied against curved surfaces. Furthermore, the applicator can be flexible and can be elastically deformed to cover the full length of a surface to be coated, and this length of surface to be coated can be greater than the "relaxed" length of the applicator defined between the first end and the second end, in which case the applicator is elastically stretched. In a variant, the applicator is capable of being elastically flexed.

To control the position of the ends, at least one of the first and second means preferably includes a rigid portion, and more preferably, a rigid portion is associated with each end of the applicator. This rigidity makes it possible to point at least one of the ends towards the surface to be coated, and to maintain a point of contact between this surface and this respective end of the applicator.

In the case where the second means is also rigid or includes a rigid portion, it is then capable of being braced obliquely through the reservoir opening, thus providing a fixed position of the second end of the applicator relative to the reservoir, even though the second means is mobile and retractable inside the reservoir when not in this braced position. In this fixed position, the second means is held preferably through the wiper element and prevents any flow of product out of the reservoir in this position. In the case where a rigid portion is associated with the portion of the applicator coupled to the reservoir, with the reservoir equipped with a wiper, during a first portion of movement of the applicator from the retracted position to the extended position, the applicator is wiped as it passes through the aperture of the wiper. During a second portion of this movement, the rigid portion passes through the aperture of the wiper, and a flange portion associated with the applicator abuts against the wiper or counterpart portion of the reservoir to prevent the applicator from becoming dislodged from the reservoir.

Also, after use, the first means can cooperate with the second means in order to reinsert the applicator into the reservoir. For example, the user can use the first means to push the second means to the bottom of the reservoir. In addition, if the applicator is flexible, it can, if desired, be wound around one of the means, and is thus directly reinserted into the receptacle at the same time as the means onto which it is wound. Preferably, the first and second means are rigid or at least include rigid portions to facilitate proper presentation of the applicator during use, and also to facilitate closure of the device after use.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
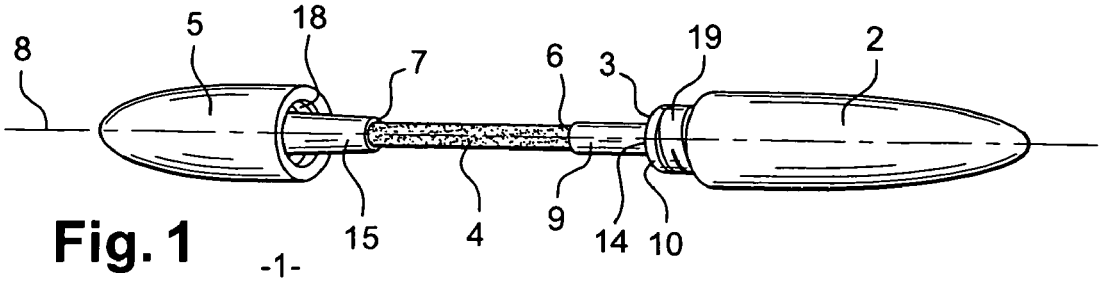
FIG. 1 is a side perspective view of an example of a device according to the invention in the open position.

FIG. 1 shows an example of a packaging and dispensing device 1 according to the invention. The device 1 includes a reservoir or container 2, inside of which is stored a quantity of product, for example, a cosmetic product. The reservoir 2 includes an opening 3 from which an applicator 4 can emerge. With the device 1 in a "closed" position, the applicator is inside the reservoir 2 in a retracted position. However, in an "open" position with the device 1 ready for use, i.e., where a cap 5 is disengaged from the reservoir 2, the applicator 4 can be withdrawn from the opening 3 to an extended position.

The applicator 4 preferably has an elongated shape delineated at each extremity by a first end 7 and a second end 6. These ends 6 and 7 preferably are opposite each other relative to a principal lengthwise axis 8 of the applicator 4. At least one of these two ends can, for example, include a boss constituting a projecting element that can be felt during application and thus forming a tactile aid to positioning a first point relative to the surface to be coated.

The applicator 4 is preferably flexible, and possibly elastically deformable. Elastically deformable is understood to mean capable of being curved or stretched. By way of example, the applicator 4 can be made of a flexible thermoplastic material, or from a bundle of synthetic or other fibers arranged parallel to each other, possibly grouped over their full length.

The applicator 4 presents at least one surface intended to be applied against a surface to be coated. This surface can be defined on an external outline of the applicator between the two ends 6 and 7. In an example where the applicator has a rectangular transverse cross-section, the applicator can present two surfaces of dissimilar widths intended to be selectively applied to the surface to be coated. A transverse cross-section of the applicator is taken to be perpendicular to the axis 8. In another example, the applicator 4 can have a circular transverse cross-section. It is to be understood that various shapes could be utilized.

A support 9 is mounted on the second end 6 of the applicator 4. Preferably, the support 9 is rigid and is partially held inside the reservoir 2. Thus, in the illustrated preferred embodiment, a rigid portion which is more rigid than the applicator is associated with a second portion or second end of the applicator. By way of example, the opening 3 of the reservoir 2 can be fitted with a means 10 to prevent the support 9 from leaving the reservoir 2. This means 10 can also perform the function of a wiper element for the applicator 4. As shown in the illustrated example, the means 10 is preferably mounted in proximity to the opening 3. It is held in this position, for example, by cooperation between a circular ring 11 provided on an outer circumference of the wiper element 10, engaging with an inner wall of the reservoir 2.

To prevent the support 9 from pulling out of the reservoir 2, the support 9 includes, for example, a flange 12 defined, for example, over an entire outer circumference of the support 9 and engaging with an edge 13 of the wiper element 10, with this edge 13 corresponding to a rim of the channel 14 formed in the wiper element 10 to allow the applicator 4 to be withdrawn from the reservoir 2. At least one portion of the support 9 can also pass through this channel 14.

With the illustrated example, when the device is in the closed position, the support 9 and the applicator 4 are concealed in the reservoir 2. In addition, in the illustrated example, the first end 7 of the applicator is connected to a rod 15 associated with the cap 5. The rod 15 is preferably rigid. It is obtained, for example, by molding with the cap 5. The rod 15 can also be an element fitted inside the cap. In this case it is preferably held in a fixed manner.

A process for assembling a device such as the device 1 includes the following steps, by way of example. In a first instance T1, the second end 6 is mounted in the support 9 and the stripping means 10 is then slid from the first end 7, which is still free, towards the second end 6, and the first end 7 is then connected to the rod 15. This subassembly can then be inserted into the reservoir 2 in a second instance T2, possibly after the reservoir 2 has been filled, by first inserting the support 9 by its end presenting the flange 12 into the opening 3. At the same time, the stripping means or wiper 10 can be moved toward the opening 3 and mounted in a fixed manner in proximity to this opening 3. By way of example, in the illustrated arrangement, a collar 16 on the stripping means 10 can be mounted tight against an edge 17 of the opening 3.

By virtue of the gravity forces, the support 9 can cause the applicator 4 to move into the reservoir under its own weight. To fully insert the applicator 4 into the reservoir, the rod 15 is also inserted into the opening 17, carrying the applicator 4 with it. If the support is still not fully inserted into the reservoir 2, it can be pushed by means of the rod 15, which is preferably rigid for this purpose.

The cap is intended to cover and close the opening 3. The cap can include a wall forming a skirt around the rod 15, and can also include a screw thread on an inner circumference 18. The outer circumference 19 of the reservoir 2, for example, at the level of a neck formed below the opening 3, can include a corresponding or counterpart projection intended to engage with the threaded inner circumference 18. As a variant, the skirt can be snapped onto the outer circumference of the neck.

In a preferred method of using the device 1, upon unscrewing of the cap 5 from the reservoir 2, these two elements can be moved apart. Preferentially, the cap 5 is moved so that the axis 20 of the rod is aligned with the axis 8 of the applicator 4 and remains in line with the axis 21 of the support 9. A pulling action is exerted on the cap 5 until the flange 12 of the support 9 bears against the stripping means 10, and until the applicator 4 is fully withdrawn from the reservoir 2. The applicator 4 is then suspended between the rod 15 and the support 9, and it is thus possible to place the rod 15 and therefore the cap 5 in an angular position 20 not superimposed on the axis 8 of the applicator 4. Similarly, the support 9 can be oriented in an angular position 21 not coincident with the axis 8 of the applicator 4, and is then braced in the stripping means 10. For example, the axes 20 and 21 can be respectively oriented substantially at 90° to the applicator 4 and placed perpendicular to and opposite the surface to be applied against the surface to be coated. The first end of the applicator 4 is disposed outside of the reservoir 2 both in the extended position and in the retracted position.

Figure 2:
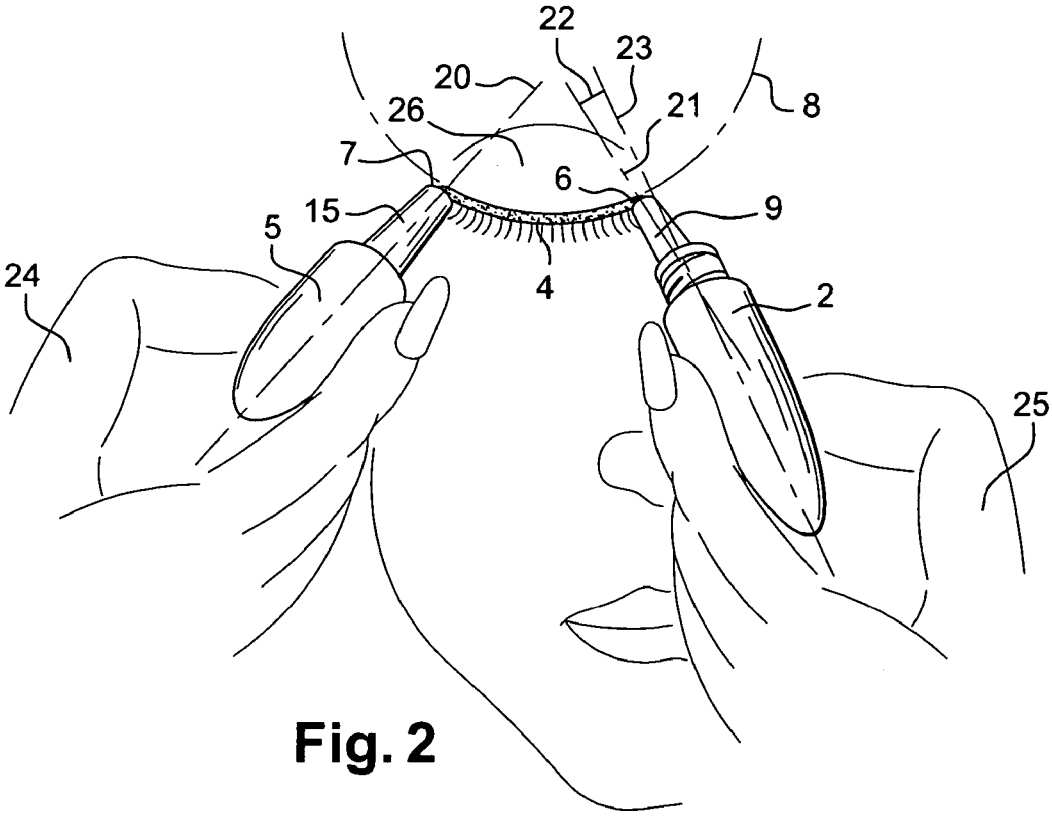
FIG. 2 illustrates a device used according to the invention.
Figure 3:
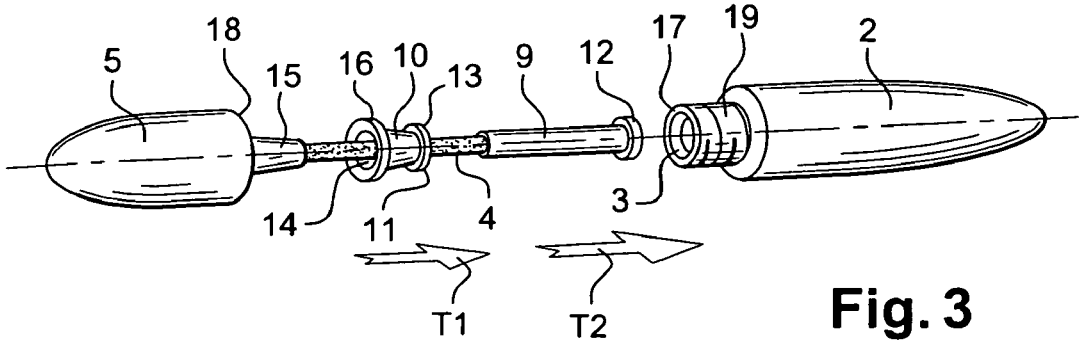
FIG. 3 is an exploded side view of a device according to the invention.

As shown in FIG. 2, to lock the position of the support 9 relative to the reservoir 2, the support 9 can be braced obliquely or transversely in the opening 3. By way of example, an angle 22 can be formed between the axis 21 of the support 9 and the exit axis 23 of the opening 3 relative to the overall geometry of the support 9 and of the wiper element 10, notably their respective diameters and lengths. The angle 22 can be, for example, between 5 and 20°. In this configuration, the user holding the cap 5 in a first hand 24 and the reservoir in a second hand 25 can place the ends 6 and 7 where desired on the surface to be coated, in this case the edge of the eyelid 26.

Preferably, the second hand 25 orients the reservoir 2 so as to position the second end 6 near an inner corner of the eyelid 26, and the first hand 24 is then lowered towards the eyelid so as to position the first end 7 near an outer corner of the eyelid 26. The length of the applicator 4 can be adjusted by winding part of the applicator 4 around the rod 15, thereby adapting it to the length required to obtain the desired line. Or conversely, the application can begin by marking the first point at the outer corner of the eyelid.

As shown in FIG. 2, as the applicator 4 is flexible, it can form a curve capable of adapting to the particular shape of the eyelid 26. In this case, it is not necessarily suspended between the support 9 and the rod 15.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A dispensing and packaging device for a product comprising:

a reservoir containing the product, said reservoir including an opening;

a cap to close the opening in the reservoir;

an applicator capable of being loaded with a quantity of the product;

a first means connecting a first end of the applicator to the cap; and a second means connecting a second end of the applicator to the reservoir, the second means being rigid and configured to be braced to maintain its orientation within the opening of the reservoir during application of the product.

2. A device according to claim 1, wherein the first means is integral with the cap.

3. A device according to claim 2, wherein the applicator remains connected to the first means and to the second means during use.

4. A device according to claim 3, wherein the second means is capable of being braced obliquely through the reservoir opening.

5. A device according to claim 1, wherein the applicator remains connected to the cap and to the reservoir during use.

6. A device according to claim 1, wherein the second means includes a support which is movably mounted inside the reservoir, and wherein the support is connected to the second end of the applicator.

7. A device according to claim 6, wherein the support includes a retaining means which engages with a counterpart arrangement on the reservoir, and wherein the counterpart arrangement prevents the support from being dislodged from the reservoir.

8. A dispensing and packaging device for a product comprising:

a reservoir containing the product, said reservoir including an opening;

a cap to close the opening in the reservoir;

an applicator capable of being loaded with a quantity of the product;

a first means connecting a first end of the applicator to the cap; and a second means connecting a second end of the applicator to the reservoir, wherein the second means includes a support which is movably mounted inside the reservoir, and wherein the support is connected to the second end of the applicator, and wherein the support includes a retaining means which engages with a counterpart arrangement on the reservoir, and wherein the counterpart arrangement prevents the support from being dislodged from the reservoir, and wherein the support comprises a flange, and wherein the counterpart arrangement comprises a wiper element mounted at the reservoir opening, and further wherein the flange is able to bear against an edge of the wiper.

9. A device according to claim 8, wherein the applicator is concealed inside the reservoir and is at least partially immersed in the product when the cap is fitted on the reservoir.

10. A device according to claim 1, wherein the applicator is concealed inside the reservoir and is at least partially immersed in the product when the cap is fitted on the reservoir.

11. A device according to claim 10, wherein the applicator is drawn by the cap out of the reservoir when the cap is disengaged from the reservoir opening.

12. A device according to claim 1, wherein the applicator is drawn by the cap out of the reservoir when the cap is disengaged from the reservoir opening.

13. A device according to claim 12, wherein the cap and reservoir are arranged such that the cap can be screwed onto the reservoir to close the reservoir opening.

14. A device according to claim 1, wherein the applicator is flexible and can be applied elastically against a curved surface to be coated.

15. A device according to claim 1, wherein the first means is rigid so as to be able to position the applicator in a desired position relative to a surface to be coated.

16. A device according to claim 1, wherein the first means cooperates with the second means to insert the applicator into the reservoir when the cap is mounted onto the reservoir.

17. A device according to claim 1, wherein the product contained in the reservoir is a cosmetic product.

18. A dispensing and packaging device for a product comprising:

a reservoir containing the product, said reservoir including an opening;

a cap to close the opening in the reservoir;

an applicator capable of being loaded with a quantity of the product;

a first means connecting a first end of the applicator to the cap; and a second means connecting a second end of the applicator to the reservoir, wherein the product contained in the reservoir is an eye make-up product.

19. A device according to claim 1, wherein said second means includes a rigid portion which at least partially extends out of said reservoir during use of said applicator.

20. A device according to claim 19, wherein said rigid portion of said second means is movable through said opening of said reservoir between a retracted position and an extended position, and wherein said rigid portion of said second means is in said extended position during use of said applicator in applying the product.

21. A device according to claim 20, wherein said second means includes a flange portion which prevents said second means from becoming dislodged from said reservoir to thereby maintain said second end of said applicator coupled to said reservoir during use.

22. A dispensing and packaging device for a product comprising:

a reservoir containing the product, said reservoir including an opening;

a cap to close the opening in the reservoir;

an applicator capable of being loaded with a quantity of the product;

a first means connecting a first end of the applicator to the cap; and a second means connecting a second end of the applicator to the reservoir, wherein said second means includes a rigid portion which at least partially extends out of said reservoir during use of said applicator, wherein said rigid portion of said second means is movable through said opening of said reservoir between a retracted position and an extended position, and wherein said rigid portion of said second means is in said extended position during use of said applicator in applying the product, wherein said second means includes a flange portion which prevents said second means from becoming dislodged from said reservoir to thereby maintain said second end of said applicator coupled to said reservoir during use, and wherein a counterpart portion is associated with said reservoir opening, and wherein said flange portion of said second means cooperates with said counterpart portion to prevent said second means from becoming dislodged from said reservoir, and wherein said flange portion of said second means contacts said counterpart portion when said rigid portion of said second means is in said extended position.

23. A device according to claim 22, wherein when said rigid portion is in said extended position said second means cooperates with said counterpart portion to prevent flow of said product out of said reservoir.

24. A device according to claim 23, wherein said counterpart portion includes an aperture which provides a wiper for said applicator.

25. A dispensing and packaging device for a product comprising:

a reservoir containing the product, said reservoir including an opening;

a cap to close the opening in the reservoir;

an applicator capable of being loaded with a quantity of the product;

a first means connecting a first end of the applicator to the cap; and a second means connecting a second end of the applicator to the reservoir, wherein said second means includes a rigid portion which at least partially extends out of said reservoir during use of said applicator, and wherein said first means includes another rigid portion which projects from said cap and which assists in positioning of said applicator during use.

26. A device according to claim 1, wherein said second means includes a flange portion which prevents said second means from becoming dislodged from said reservoir to thereby maintain said second end of said applicator coupled to said reservoir during use.

27. A device according to claim 26, wherein said applicator is movable between an extended position in which at least one portion of said applicator is disposed outside of said reservoir for use in applying said product and a retracted position in which said one portion of said applicator is disposed inside of said reservoir, and wherein said first and second ends of said applicator are maintained coupled respectively to said cap and to said reservoir both in said extended position and in said retracted position.

28. A device according to claim 27, wherein said applicator is flexible.

29. A device according to claim 1, wherein said product is a cosmetic product.

30. A dispensing and packaging device for a product comprising:

a reservoir containing the product, said reservoir including an opening;

a cap to close the opening in the reservoir;

an applicator capable of being loaded with a quantity of the product;

a first means connecting a first end of the applicator to the cap; and a second means connecting a second end of the applicator to the reservoir, wherein said product is an eye make-up product.

31. A dispensing and packaging device for a product, comprising:

a reservoir containing the product, said reservoir including an opening;

a cap to cover the opening of the reservoir;

an applicator capable of being loaded with a quantity of the product, said applicator including a first end and a second end, wherein said applicator is movable between an extended position and a retracted position, and wherein at least one portion of said applicator is disposed inside of said reservoir in said retracted position, and further wherein said one portion is disposed outside of said reservoir in said extended position, wherein in said retracted position said applicator picks up product in the reservoir to become loaded with said product and in said extended position said applicator is used to apply said product; and a flange portion associated with said applicator, wherein said flange portion is at least partially disposed in said reservoir when said applicator is in said retracted position, and wherein said flange portion is configured such that it is not separated from said reservoir when said applicator is in said extended position, and further wherein said flange portion is positioned with respect to said second end of said applicator such that said second end of said applicator is disposed inside of said reservoir at least when said applicator is in said retracted position and such that said second end of said applicator is coupled to said reservoir both when said applicator is in said retracted position and when said applicator is in said extended position, the flange portion being rigid and configured to be braced to maintain its orientation within the opening of the reservoir during application of the product.

32. A device according to claim 31, wherein said first end of said applicator is disposed outside of said reservoir both in said extended position and in said retracted position.

33. A device according to claim 32, further including a rigid portion extending from said flange portion, said rigid portion extending at least partially out of said reservoir when said applicator is in said extended position.

34. A device according to claim 33, wherein said reservoir includes a counterpart portion against which said flange portion abuts to prevent said flange portion and said second end of said applicator from becoming dislodged from said reservoir.

35. A device according to claim 34, wherein said counterpart portion includes an aperture, and wherein said rigid portion extends through said aperture when said applicator is in said extended position.

36. A device according to claim 35, wherein said first end of said applicator is coupled to another rigid portion, whereby when said applicator is in said extended position said rigid portion and said another rigid portion assist in positioning of said applicator for application of said product.

37. A device according to claim 36, wherein during a first portion of movement of said applicator from said retracted position to said extended position said applicator is wiped as it passes through said aperture of said counterpart portion, and further wherein during a second portion of movement of said applicator from said retracted position to said extended position said rigid portion passes through said aperture.

38. A device according to claim 36, wherein said another rigid portion is coupled to said cap to thereby couple said first end of said applicator to said cap and such that during removal of said cap from said reservoir said applicator is moved from said retracted position to said extended position.

39. A device according to claim 35, wherein during a first portion of movement of said applicator from said retracted position to said extended position said applicator is wiped as it passes through said aperture of said counterpart portion, and further wherein during a second portion of movement of said applicator from said retracted position to said extended position said rigid portion passes through said aperture.

40. A device according to claim 31, wherein said first end of said applicator is coupled to said cap whereby during removal of said cap from said reservoir said applicator is moved from said retracted position to said extended position.

41. A device according to claim 40, wherein said applicator is flexible, and wherein a first rigid portion is coupled to said cap and said first end of said applicator is coupled to said first rigid portion, and further wherein a second rigid portion is coupled to said flange portion and said second end of said applicator is coupled to said second rigid portion, and wherein said first and second rigid portions assist in positioning of said applicator when said applicator is in said extended position.

42. A device according to claim 41, wherein said reservoir includes a counterpart portion against which said flange portion abuts to prevent said flange portion and said second end of said applicator from becoming dislodged from said reservoir.

43. A device according to claim 31, wherein said reservoir includes a counterpart portion having an aperture therethrough, and wherein during at least a first portion of movement from said retracted position to said extended position said applicator is wiped as it passes through said aperture, and wherein at a conclusion of movement of said applicator from said retracted position to said extended position said flange portion abuts against said counterpart portion to prevent said applicator from becoming dislodged from said reservoir.

44. A device according to claim 43, wherein said first end of said applicator is coupled to said cap.

45. A dispensing and packaging device for a product comprising:

a reservoir containing the product;

a cap removably mountable on the reservoir;

an applicator capable of being loaded with a quantity of the product, wherein said applicator includes a first portion coupled to said cap and a second portion coupled to said reservoir;

wherein said applicator is movable between a retracted position in which said applicator is loaded with said product in said reservoir and an extended position in which said applicator can be used to apply said product, and further wherein said applicator is moved from said retracted position to said extended position upon removal of said cap from said reservoir; and wherein said first portion of said applicator remains coupled to said cap both in said retracted position and in said extended position and said second portion of said applicator remains coupled to said reservoir by a support portion both in said retracted position and in said extended position, the support portion being rigid and configured to be braced to maintain its orientation within the opening of the reservoir during application of the product.

46. A device according to claim 45, wherein said reservoir includes an aperture associated therewith through which at least part of said applicator passes as it moves from said retracted position to said extended position, and wherein a flange portion is associated with said second portion of said applicator and said flange portion has at least one dimension sized such that said flange portion does not pass through said aperture to thereby prevent said second portion of said applicator from becoming dislodged from said reservoir.

47. A device according to claim 46, wherein said applicator is flexible, and wherein a rigid portion is associated with said flange portion, and wherein at least part of said rigid portion extends through said aperture when said applicator is in said extended position, and further wherein another rigid portion is associated with said cap and said first portion of said applicator, whereby said rigid portion and said another rigid portion assist in positioning of said applicator for application of said product when said applicator is in said extended position.

48. A device according to claim 47, wherein said reservoir includes a counterpart portion inserted into an opening of said reservoir, and wherein said counterpart portion includes said aperture extending therethrough, and further wherein said flange portion abuts against said counterpart portion when said applicator is in said extended position to thereby prevent said second portion of said applicator from becoming dislodged from said reservoir.

49. A device according to claim 48, wherein said product is a cosmetic product.

50. A device according to claim 48, wherein said product is an eye make-up product.

51. A device for a product comprising:

a reservoir containing the product;

a cap removably mountable on the reservoir;

an applicator capable of being loaded with a quantity of the product, wherein said applicator includes a first portion coupled to said cap and a second portion coupled to said reservoir;

wherein said applicator is movable between a retracted position in which said applicator is loaded with said product in said reservoir and an extended position in which said applicator can be used to apply said product, and further wherein said applicator is moved from said retracted position to said extended position upon removal of said cap from said reservoir;

wherein said first portion of said applicator remains coupled to said cap both in said retracted position and in said extended position and said second portion of said applicator remains coupled to said reservoir both in said retracted position and in said extended position;

wherein said reservoir includes an aperture associated therewith through which at least part of said applicator passes as it moves from said retracted position to said extended position, and wherein a flange portion is associated with said second portion of said applicator and said flange portion has at least one dimension sized such that said flange portion does not pass through said aperture to thereby prevent said second portion of said applicator from becoming dislodged from said reservoir;

wherein said applicator is flexible, and wherein a rigid portion is associated with said flange portion, and wherein at least part of said rigid portion extends through said aperture when said applicator is in said extended position, and further wherein another rigid portion is associated with said cap and said first portion of said applicator, whereby said rigid portion and said another rigid portion assist in positioning of said applicator for application of said product when said applicator is in said extended position; and wherein during a first portion of movement from said retracted position to said extended position said applicator is wiped as it passes through said aperture, and wherein during a second position of movement of said applicator from said retracted position to said extended position said rigid portion extends through said aperture.

* * * * *